United States Patent [19]

Davenport et al.

[11] Patent Number: 5,048,492

[45] Date of Patent: Sep. 17, 1991

[54] AIR/FUEL RATIO CONTROL SYSTEM AND METHOD FOR FUEL VAPOR PURGING

[75] Inventors: Martin F. Davenport, Plymouth; Daniel V. Orzel, Westland; Douglas R. Hamburg, Birmingham, all of Mich.

[73] Assignee: Ford Motor Company, Dearborn, Mich.

[21] Appl. No.: 622,651

[22] Filed: Dec. 5, 1990

[51] Int. Cl.[5] ..... F02M 25/08

[52] U.S. Cl. ..... 123/489; 123/520

[58] Field of Search ..... 123/440, 489, 518, 519, 123/520

[56] References Cited

U.S. PATENT DOCUMENTS

| | | | |
|---|---|---|---|
| 4,641,623 | 2/1987 | Hamburg | 123/518 |
| 4,677,956 | 7/1987 | Hamburg | 123/520 |
| 4,715,340 | 12/1987 | Cook et al. | 123/406 |
| 4,741,318 | 5/1988 | Kortge et al. | 123/520 |
| 4,748,959 | 6/1988 | Cook et al. | 123/520 |
| 4,763,634 | 8/1988 | Morozumi | 123/520 |
| 4,841,940 | 6/1989 | Uranishi et al. | 123/489 X |
| 4,932,386 | 6/1990 | Uozumi et al. | 123/520 |
| 4,967,713 | 11/1990 | Kojima | 123/520 X |

FOREIGN PATENT DOCUMENTS

| | | | |
|---|---|---|---|
| 0065244 | 4/1985 | Japan | 123/520 |
| 0001857 | 1/1986 | Japan | 123/520 |

*Primary Examiner*—Willis R. Wolfe

*Attorney, Agent, or Firm*—Allan J. Lippa; Peter Abolins

[57] ABSTRACT

A system and method for controlling operation of an engine wherein a fuel vapor recovery system is coupled between an air/fuel intake and a fuel supply system. An air/fuel ratio indication is provided by a proportional plus integral feedback controller coupled to a two-state exhaust gas oxygen sensor. In response to the air/fuel ratio indication and a measurement of inducted air flow, a base fuel command is generated. To compensate for purging of fuel vapors, a reference air/fuel ratio is subtracted from the air/fuel ratio indication and the resulting error signal generated. This compensation factor represents a learned value which is directly related to fuel vapor concentration, and it is subtracted from the base fuel command to correct for induction of fuel vapors. At initiation of fuel vapor purging, the rate of purge flow is incremented a predetermined amount with each change in state of the exhaust gas oxygen sensor.

15 Claims, 4 Drawing Sheets time
$t_1$
$t_2$
$t_3$
$t_4$
$t_5$
$t_6$
$t_7$
$t_8$
RICH
LEAN
EGO
Pfd
Pf
LAMBSE
PCOMP

AIR/FUEL RATIO CONTROL SYSTEM AND METHOD FOR FUEL VAPOR PURGING

BACKGROUND OF THE INVENTION

The field of the invention relates to air/fuel ratio control for motor vehicles having a fuel vapor recovery system coupled between the fuel supply system and the air/fuel intake of an internal combustion engine.

Efficient operation of internal combustion engines requires the engine's air/fuel ratio be maintained within an operating window of the catalytic converter. For a typical three-way catalytic converter ($NO_X$, CO, and HC), the desired air/fuel ratio is referred to as stoichiometry which is typically 14.7 lbs. air/lb. fuel. Engine operation at the desired air/fuel ratio is approached by an air/fuel ratio feedback control system responsive to an exhaust gas oxygen sensor. More specifically, a fuel charge is first determined for open loop operation by dividing a measurement of inducted airflow by the desired air/fuel ratio (such as 14.7). This open loop charge is then trimmed by a feedback correction factor responsive to the exhaust gas oxygen sensor. In this manner, steady-state engine operation is maintained near the desired air/fuel ratio.

Air/fuel ratio control has been complicated by the addition of fuel vapor recovery systems. To reduce emissions of gasoline vapors into the atmosphere, as required by government emission standards, fuel vapor recovery systems are commonly utilized. These systems store excess fuel vapors emitted from the fuel tank in a canister having activated charcoal or other hydrocarbon absorbing material. To replenish the canisters storage capacity, air is periodically purged through the canister, absorbing stored hydrocarbons, and the mixture of vapors and purged air inducted into the engine. Concurrently, vapors are inducted directly from the fuel tank into the engine.

A problem with the above described approach to air/fuel ratio control is that induction of rich fuel vapors may exceed the feedback system's range of authority resulting in undesired engine air/fuel operation. Another problem is that any perturbation in inducted airflow, such as caused by sudden changes in throttle position, results in an air/fuel transient due to the feedback systems response time.

U.S. Pat. No. 4,715,340 has attempted to solve the above problems. A combined air/fuel ratio feedback control system and vapor purge system is disclosed wherein the rate of purged vapor flow is made proportional to the rate of inducted airflow. Allegedly, any change in inducted airflow will then be accompanied by a corresponding change in purged vapor flow such that the over all air/fuel ratio is not significantly perturbed during sudden changes in throttle position.

U.S. Pat. No. 4,641,623 addresses another of the above described problems. To reduce air/fuel transients which may be caused by the onset of fuel vapor purge, the '623 patent discloses gradually ramping on purge flow such that the feedback system may gradually track the inducted change in an air/fuel mixture.

Kortge et al U.S. Pat. No. 4,741,318 addresses the above described problem of purge fuel vapors exceeding the feedback system's range of authority. Kortge et al discloses a feedback control system wherein the output of an exhaust gas oxygen sensor is integrated to provide a correction factor for injected liquid fuel. During fuel vapor purging, the rate of purge flow is increased until such integrated value exceeds a predetermined value associated with the limit of the feedback system's range of authority. When this value is reached, further increases in the rate of purge flow are either inhibited or the rate of purge flow is decreased. Accordingly, the rate of purge flow is continuously adjusted such that induction of purged fuel vapors does not exceed the feedback system's range of authority.

The inventors herein have recognized numerous disadvantages with the above described prior art approaches. For example, the '318 patent and the '340 patent teach limiting the rate of purge flow such that the feedback system's range of authority is not exceeded. A disadvantage of these approaches is that fuel vapors may be generated in the fuel system at a greater rate than they are purged into the engine. Accordingly, the vapor storage canister may become saturated and excess fuel vapors emitted directly into the atmosphere.

SUMMARY OF THE INVENTION

An object of the invention described herein is to provide induction of purged fuel vapors at a maximum rate without affecting the air/fuel ratio feedback system's range of operating authority.

The above objects are achieved, and disadvantages of prior approaches overcome, by providing both a control system and method for controlling air/fuel operation of an engine wherein a fuel vapor recovery system is coupled between an air/fuel intake and a fuel supply system. In one particular aspect of the invention, the control system comprises: induction means for inducting a mixture of ambient air and liquid fuel into the air/fuel intake; purging means coupled to the fuel supply system and the fuel vapor recovery system for periodically purging a vapor mixture of fuel vapor and purged air into the engine air/fuel intake; an exhaust gas oxygen sensor coupled to the engine exhaust providing an output indication in a first state when engine exhaust gases are richer than a predetermined value and providing the output indication in a second state when the engine exhaust gases are leaner than the predetermined value; feedback means coupled to the exhaust gas oxygen sensor for providing an air/fuel ratio indication of engine operation and for correcting the liquid fuel inducted into the engine in response to the air/fuel ratio indication; learning means responsive to a deviation in the air/fuel ratio indication from a desired air/fuel ratio for providing a measurement of fuel vapor content in the purged vapor mixture, the learning means also correcting the inducted liquid fuel in response to the fuel vapor content measurement to maintain the desired air/fuel ratio during the periodic purging; and purge control means responsive to the learning means for incrementing rate of purge flow from zero flow at initiation of the periodic purging to a desired and substantially constant rate of purge flow by increasing the rate of purge flow a predetermined amount when the exhaust gas oxygen sensor changes the output indication.

An advantage of the above aspect of the invention is that the learning means corrects the air/fuel ratio for purged fuel vapors such that the range of authority of the feedback means is not affected by such purging. Another advantage is that the rate of purge flow is maintained at a maximum constant value whereas the rate of purge flow was decreased in prior approaches to prevent exceeding the feedback system's range of authority. Still another advantage is that by increasing purge flow from zero to the desired value in predetermined amounts upon each switching of the exhaust gas oxygen sensor, the feedback system's range of authority is not exceeded before the learning means, having a slower response time, is able to correct for induction of fuel vapors. Furthermore, this gradual increase in purge flow prevents air/fuel transients which might otherwise occur due to the propagation delay of air/fuel charge through the engine to the exhaust gas oxygen sensor.

BRIEF DESCRIPTION OF THE DRAWINGS

The object and advantages of the invention described above and others will be more clearly understood by reading an example of an embodiment in which the invention is used to advantage, referred to herein as the Preferred Embodiment, with reference to the attached drawings wherein.

DESCRIPTION OF THE PREFERRED EMBODIMENT

Figure 1:
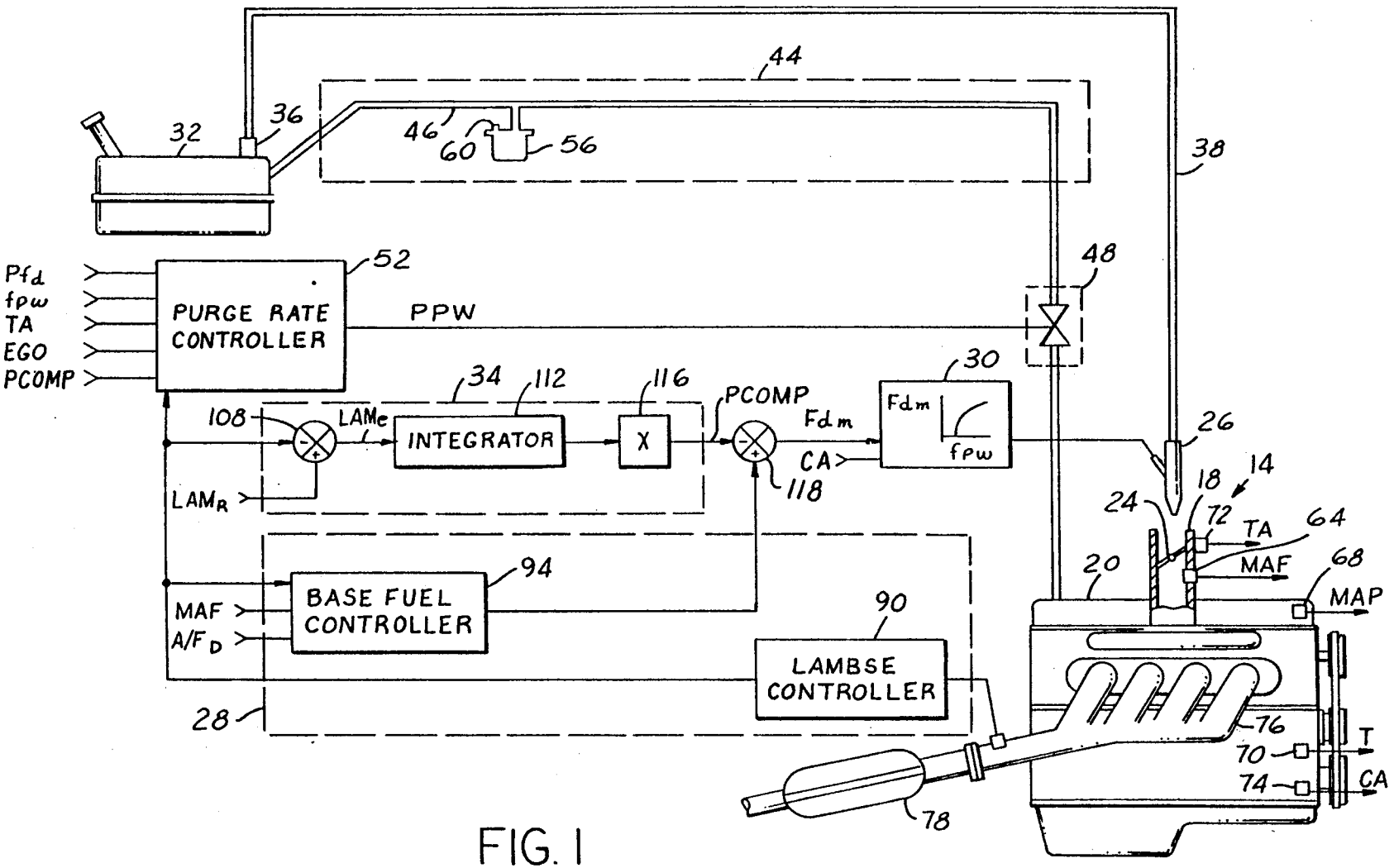
FIG. 1 is a block diagram of an embodiment wherein the invention is used to advantage.

Referring first to FIG. 1, engine 14 is shown as a central fuel injected engine having throttle body 18 coupled to intake manifold 20. Throttle body 18 is shown having throttle plate 24 positioned therein for controlling the induction of ambient air into intake manifold 20. Fuel injector 26 injects a predetermined amount of fuel into throttle body 18 in response to fuel controller 30. As described in greater detail later herein, fuel controller 30 is controlled by both air/fuel feedback system 28 and fuel vapor control system 34. Fuel is delivered to fuel injector 26 by a conventional fuel system including fuel tank 32, fuel pump 36, and fuel rail 38.

Fuel vapor recovery system 44 is shown coupled between fuel tank 32 and intake manifold 20 via purge line 46 and purge control valve 48. In this particular example, fuel vapor recovery system 44 includes vapor purge line 46 connected to fuel tank 32 and canister 56 which is connected in parallel to fuel tank 32 for absorbing fuel vapors therefrom by activated charcoal contained within the canister. For reasons described later herein, purge control valve 48 is controlled by purge rate controller 52 to maintain a substantially constant flow of vapors therethrough regardless of the rate of air inducted into throttle body 18 or the manifold pressure of intake manifold 20. In this particular example, valve 48 is a pulse width actuated solenoid valve having constant cross-sectional area. A valve having a variable orifice may also be used to advantage such as a control valve supplied by SIEMENS as part no. F3DE-9C915-AA.

During fuel vapor purge, air is drawn through canister 56 via inlet vent 60 absorbing hydrocarbons from the activated charcoal. The mixture of purged air and absorbed vapors is then inducted into intake manifold 20 via purge control valve 48. Concurrently, fuel vapors from fuel tank 32 are drawn into intake manifold 20 via purge control valve 48.

Conventional sensors are shown coupled to engine 14 for providing indications of engine operation. In this example, these sensors include mass airflow sensor 64 which provides a measurement of mass airflow (MAF) inducted into engine 14. Manifold pressure sensor 68 provides a measurement (MAP) of absolute manifold pressure in intake manifold 20. Temperature sensor 70 provides a measurement of engine operating temperature (T). Throttle angle sensor 72 provides throttle position signal TA. Engine speed sensor 74 provides a measurement of engine speed (rpm) and crank angle (CA).

Engine 14 also includes exhaust manifold 76 coupled to conventional 3-way ($NO_X$, CO, HC) catalytic converter 78. Exhaust gas oxygen sensor 80, a conventional two-state oxygen sensor in this example, is shown coupled to exhaust manifold 76 for providing an indication of air/fuel ratio operation of engine 14. More specifically, exhaust gas oxygen sensor 80 provides a signal having a high state when air/fuel ratio operation is on the rich side of a predetermined air/fuel ratio commonly referred to as stoichiometry (14.7 lbs. air/lb. fuel in this particular example). When engine air/fuel ratio operation is lean of stoichiometry, exhaust gas oxygen sensor 80 provides its output signal at a low state.

Air/fuel feedback system 28 is shown including LAMBSE controller 90 and base fuel controller 94. LAMBSE controller 90, a proportional plus integral controller in this particular example, integrates the output signal from exhaust gas oxygen sensor 80. The output control signal (LAMBSE) provided by LAMBSE controller 90 is at an average value of unity when engine 14 is operating at stoichiometry and there are no steady-state air/fuel errors or offsets. For a typical example of operation, LAMBSE ranges from 0.75–1.25.

Base fuel controller 94 provides desired fuel charge signal Fd by dividing signal MAF by both LAMBSE and a reference or desired air/fuel ratio ($A/F_D$) such as stoichiometry as shown by the following equation.

$$Fd = \frac{MAF}{LAMBSE * A/F_D}$$

During open loop operation, such as when engine 14 is cool and corrections from exhaust gas oxygen sensor 80 are not desired, signal LAMBSE is forced to unity.

Continuing with FIG. 1, fuel vapor control system 34 provides output signal PCOMP representing a measurement of the mass flow of fuel vapors into intake manifold 20 during purge operation. More specifically, reference signal $LAM_R$, unity in this particular example, is subtracted from signal LAMBSE to generate error signal $LAM_e$. Integrator 112 integrates signal $LAM_e$ and provides an output to multiplier 116 for multiplication by a preselected scaling factor. Fuel vapor control system 34 is therefore a feedback air/fuel ratio controller responsive to fuel vapor purging and having a slower response time than air/fuel feedback system 28.

The resulting signal PCOMP from multiplier 116 is subtracted from desired fuel signal Fd in summer 118 to generate modified desired fuel charge signal (Fdm). Fuel controller 30 converts signal Fdm into signal fpw having a pulse width directly correlated to signal Fdm. Fuel injector 26 is actuated during the pulse width of signal fpw such that the desired amount of fuel is metered into engine 14 for maintaining the desired air/fuel ratio ($A/F_D$).

Those skilled in the art will recognize that the operations described for air/fuel feedback system 28 and fuel vapor control system 34 may be performed by a microcomputer in which case the functional blocks shown in FIG. 1 are representative of program steps. These operations may also be performed by discrete IC's or analog circuitry.

An example of operation of the embodiment shown in FIG. 1, and fuel fuel vapor control system 34 in particular, is described with reference to operating conditions illustrated in FIGS. 2A–2H. For ease of illustration, zero propagation delay is assumed for an air/fuel charge to propagate through engine 14 to exhaust gas oxygen sensor 80. Propagation delay of course is not zero, but may be as high as several seconds. Any propagation delay would further dramatize the advantages of the invention herein over prior approaches.

Steady-state engine operation is shown before time $t_1$ wherein inducted airflow, as represented by signal MAF, is at steady-state, signal LAMBSE is at an average value of unity, purge has not yet been initiated, and the actual engine air/fuel ratio is at an average value of stoichiometry (14.7 in this particular example).

Figure 2A:
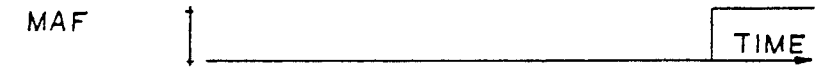
FIGS. 2A–2H illustrate various electrical waveforms associated with the block diagram shown in FIG. 1.
Figure 2B:
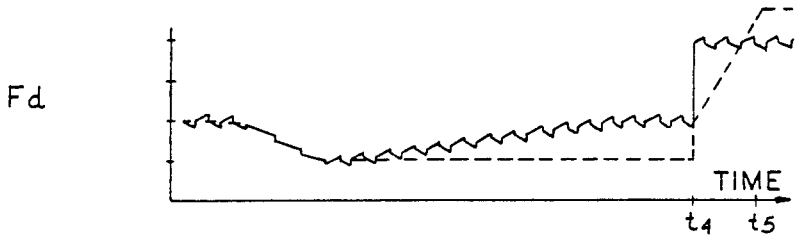
Figure 2C:
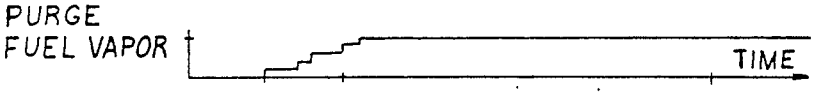

Referring first to FIG. 2C, vapor purge is initiated at time $t_1$. As described in greater detail later herein with particular reference to FIG. 3 and FIGS. 4A–4E, the rate of purge flow is gradually increased until it reaches the desired value at time $t_2$. For this particular example, the desired rate of purge flow is a maximum wherein the duty cycle of signal ppw is 100%. Since the inducted mixture of air, fuel, purged fuel vapor, and purged air becomes richer as the purge flow is turned on, signal LAMBSE will gradually increase as purged fuel vapors are being inducted as shown between times $t_1$ and $t_2$ in FIG. 2D. In response to this increase in signal LAMBSE, base fuel controller 94 gradually decreases desired fuel charge signal Fd as shown in FIG. 2B such that the overall actual air/fuel ratio of engine 14 remains, on average, at 14.7 (see FIG. 2H). Stated another way, fuel delivered is decreased as fuel vapor is increased to maintain the desired air/fuel ratio.

Figure 2D:
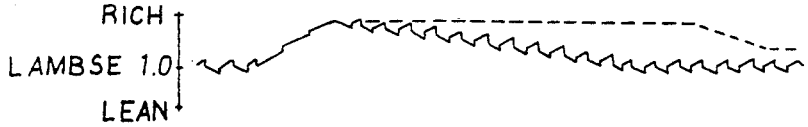
Figure 2E:
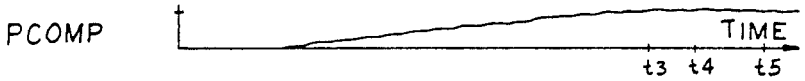
Figure 2F:
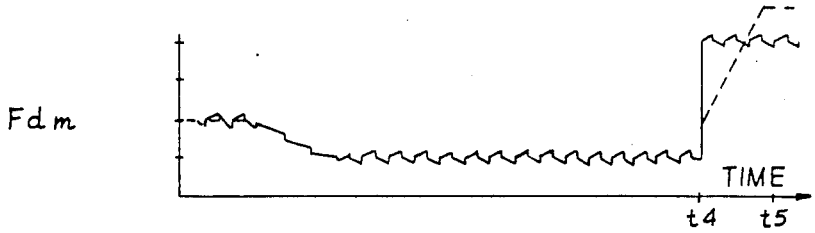

Referring to FIGS. 2D and 2E, fuel vapor control system 34 provides signal PCOMP at a gradually increasing value as signal LAMBSE deviates from its reference value of unity. More specifically, as previously discussed herein, signal PCOMP is an integral of the difference between signal LAMBSE and its reference value of unity. It is seen that as signal PCOMP increases, the liquid fuel delivered (Fdm) to engine 14 is decreased such that signal LAMBSE is forced downward until an average value of unity is achieved at time $t_3$. At this time, signal PCOMP reaches the value corresponding to the amount of purged fuel vapors.

Accordingly, fuel vapor control system 34 adaptively learns the concentration of purged fuel vapors during a purge and compensates the overall engine air/fuel ratio for such purged fuel vapors. The operating range of authority of air/fuel feedback system 28 is therefore not reduced during fuel vapor purging. Any perturbation caused in engine air/fuel ratio by factors other than purged fuel vapors, such as perturbations in inducted airflow, are corrected by base fuel controller 94 in response to signal LAMBSE.

Figure 2G:
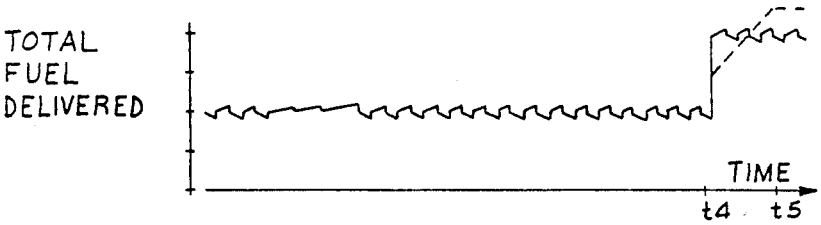

Referring to FIG. 2B and continuing with FIGS. 2D and 2E, it is seen that desired fuel signal Fd provided by base fuel controller 94 increases in correlation with a decrease in signal LAMBSE until, at time $t_3$, signal Fd reaches its value before introduction of purging. However, referring to FIG. 2F, modified desired fuel signal Fdm reaches a steady-state value commencing at time $t_2$ by operation of signal PCOMP (i.e., Fdm=Fd−PCOMP) such that the total fuel delivered to the engine (injected fuel plus purged fuel vapors) remains substantially constant before and during purging operation as shown in FIG. 2G. Fuel vapor control system 34 therefore essentially a measures the amount of fuel vapors purged during purging operations. And base fuel controller 94 generates a desired fuel charge signal Fd representative of fuel required to maintain the desired engine air/fuel ratio independently of purging operations.

The illustrative example continues under conditions where the engine throttle, and accordingly inducted airflow (MAF), are suddenly changed as shown at time $t_4$ in FIG. 2A. Since the rate of purge flow is maintained substantially constant, signal PCOMP remains at a substantially constant value despite the sudden change in inducted airflow (see FIG. 2E). Correction for the lean offset provided by the sudden increase in inducted airflow will then be provided by base fuel controller 94 (as described previously herein and as further illustrated in FIGS. 2B, 2F, and 2G, and 2H). On the other hand, without operation of fuel vapor control 34, a transient in engine air/fuel ratio would result with any sudden increase in throttle angle. This, as previously discussed, is indicative of prior feedback approaches.

Figure 2H:
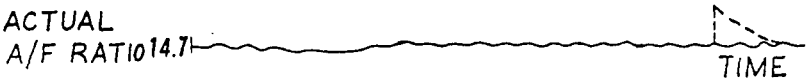

To illustrate the above problem, dashed lines are shown in FIGS. 2B, 2D, 2F, 2G, and 2H which are illustrative of operation without fuel vapor control system 34 and its output signal PCOMP. It is seen that the sudden change in airflow at time $t_4$ causes a lean perturbation in air/fuel ratio until signal LAMBSE provides a correction at time $t_5$. This perturbation occurs because base fuel controller 94 initially offsets desired fuel charge Fd in response to the increase in signal MAF (i.e., Fd=MAF/14.7*LAMBSE). The overall air/fuel mixture is now leaner than before time $t_4$ because purge vapor flow has not increased in proportion to the increase in inducted airflow. LAMBSE controller 90 will detect this lean offset during the time interval from $t_4$ through $t_5$ and base fuel controller 94 will appropriately adjust the fuel delivered by time $t_5$. However, an air/fuel transient occurs between times $t_4$ and $t_5$ as shown in FIG. 2H due to the response time of LAMBSE controller 90.

Figure 3:
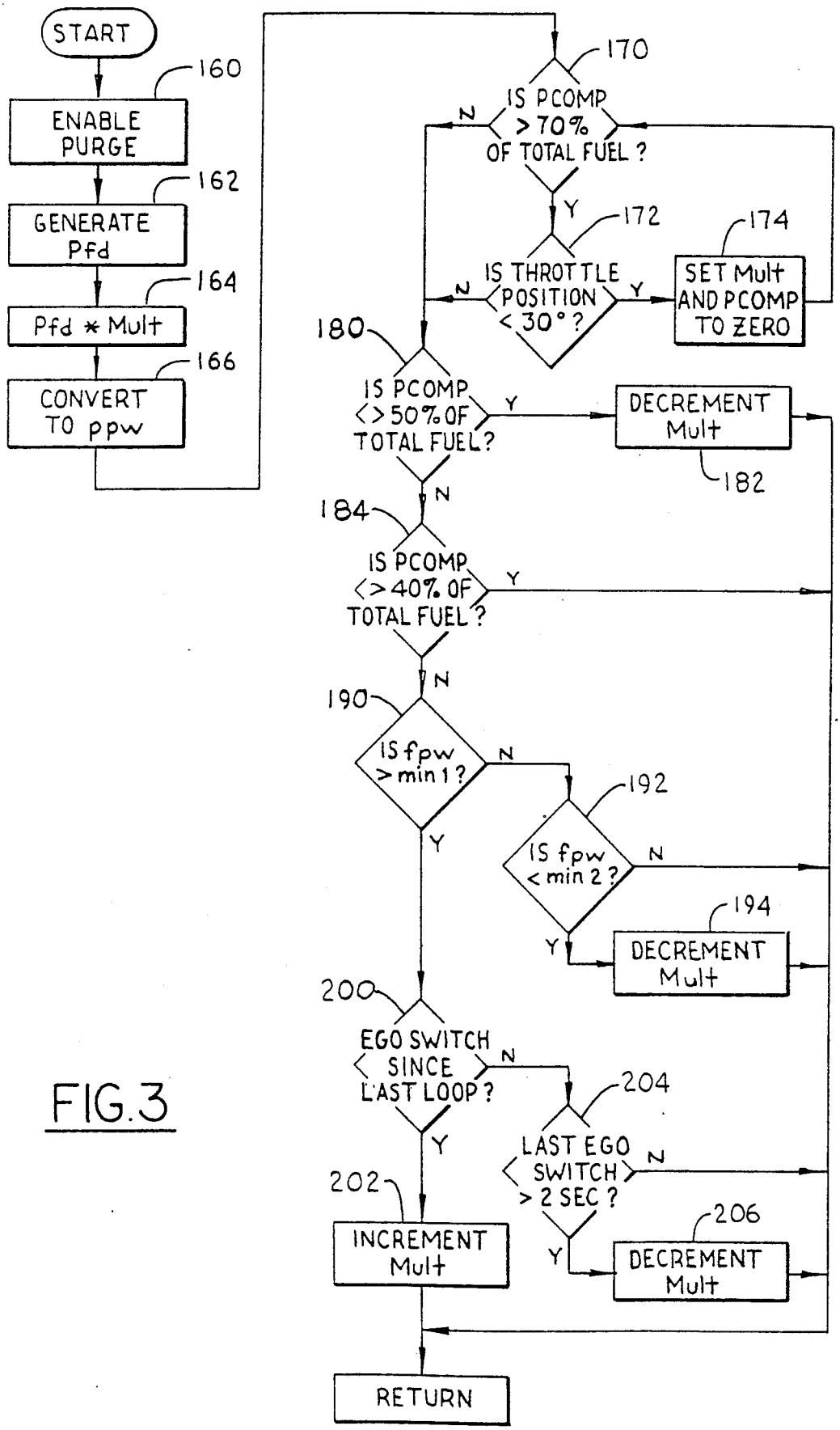
FIG. 3 is a high level flowchart illustrating various program steps performed by a portion of the components illustrated in FIG. 1.

Operation of purge rate controller 52 is now described in more detail with reference to FIG. 3 and FIGS. 4A–4F. Referring first to FIG. 3, purge is enabled as a function of engine temperature during step 160. Desired purge flow signal Pfd is generated during step 162. In this particular example, signal Pfd is the maximum purge flow obtainable through purge control valve 48 (i.e., 100 duty cycle) to prevent emissions of hydrocarbons, operate engine 14 more efficiently, and reduce fuel system pressure. Unlike prior approaches, maximum purge flow is obtainable without exceeding the operating range of authority of air/fuel feedback system 28.

During step 164, signal Pfd is multiplied by a scaling factor shown as signal Mult. As described in greater detail below, signal Mult is incremented in predetermined steps to a maximum value of unity for controlling the turn on of purge flow. The product Pfd * Mult is converted to the corresponding pulse width modulated signal ppw in step 166. For example, if signal Mult is 0.5, signal ppw is generated with a 50% duty cycle.

During steps 170–174, purge is disabled under sudden deceleration conditions when there is an appreciable fuel vapor concentration to prevent temporary driveability problems. More specifically, a determination of whether fuel vapors comprise more than 70% of total fuel (fuel vapor plus liquid fuel) is made during step 170. In this particular example, signal PCOMP is divided by the sum of signal Fd plus signal PCOMP. If this ratio is greater than 70%, and the throttle position is less than 30° (see step 172), then purge is disabled by setting signal Mult and signal PCOMP to zero (see step 174). However, if the ratio PCOMP/(Fdm+PCOMP) is less than 70%, or throttle position is greater than 30°, the process continues with step 180.

During steps 180 and 182, signal Mult is decremented a predetermined amount if the fuel vapor contribution of total fuel is greater than 50%. When the fuel vapor contribution is less than 50%, but greater than 40%, the program is exited without further changes to signal Mult (see step 184) such that the rate of purge flow remains the same. When fuel vapor concentration is less than 40% of total fuel, the program advances to step 90. It is noted that the functions performed by steps 180–184 may be accomplished by other means. For example, a simple comparison of signal PCOMP to various Preselected values may also be used to advantage for either decrementing purge flow during initiation of purging operations, or holding it constant, when there are high concentrations of fuel vapors.

During step 190, fuel injector pulse width signal fpw is compared to a first minimum value (min1) which defines an upper level of a pulse width dead band. If signal fpw is greater than min1, processing continues with program step 200. On the other hand, when signal fpw is less than min1, but greater than a minimum pulse width associated with the lower level of such dead band (min2), the rate of purge flow is not altered and the program exited (see step 192). Under such conditions the fuel injector pulse width signal fpw is within the dead band. However, when signal fpw is less than min2, the rate of purge flow is decremented a predetermined amount by decrementing signal Mult a corresponding predetermined amount (see steps 192 and 194).

When fuel injector pulse width signal fpw is above the dead band (i.e., greater than min1) the program continues with steps 200–206. Signal Mult is incremented a predetermined amount when exhaust gas oxygen sensor 80 (hereinafter referred to as EGO) has switched states since the last program background loop (see steps 200 and 202). If there has not been an EGO switch during a predetermined time, such as two seconds, signal Mult is decremented by a predetermined time (see steps 204 and 206). However, if there has been an EGO switch during such predetermined time, the rate of purge flow remains the same (see step 204). Accordingly, during initiation of the purging process, the rate of purge flow is gradually increased with each change in state of exhaust gas oxygen sensor 80. In this manner, purge flow is turned on at a gradual rate to its maximum value (i.e., signal Mult incremented to unity) when indications (EGO switching) are provided indicating that air/fuel feedback system 28 and fuel vapor control system 34 are properly compensating for purging of fuel vapors.

The above operation may be more clearly understood by reviewing the illustrative example presented in FIGS. 4A–4F. For ease of illustration, zero propagation delay of an air/fuel charge through the engine is assumed. An enable purge command is shown provided at time $t_1$ by purge rate controller 52 in FIG. 4A. Exhaust gas oxygen sensor 80 is shown cycling between the rich side and lean side of stoichiometry before time $t_1$ indicating that the average air/fuel ratio is at stoichiometry. At time $t_2$ exhaust gas oxygen sensor 80 is shown switching rich, and signal Mult is increased a predetermined amount by purge rate controller 52 as previously described. In response, purge valve 48 is modulated by signal ppw such that purge flow begins at time $t_2$ (see FIG. 4C).

Figures 4A, 4B, 4C, 4D, 4E:
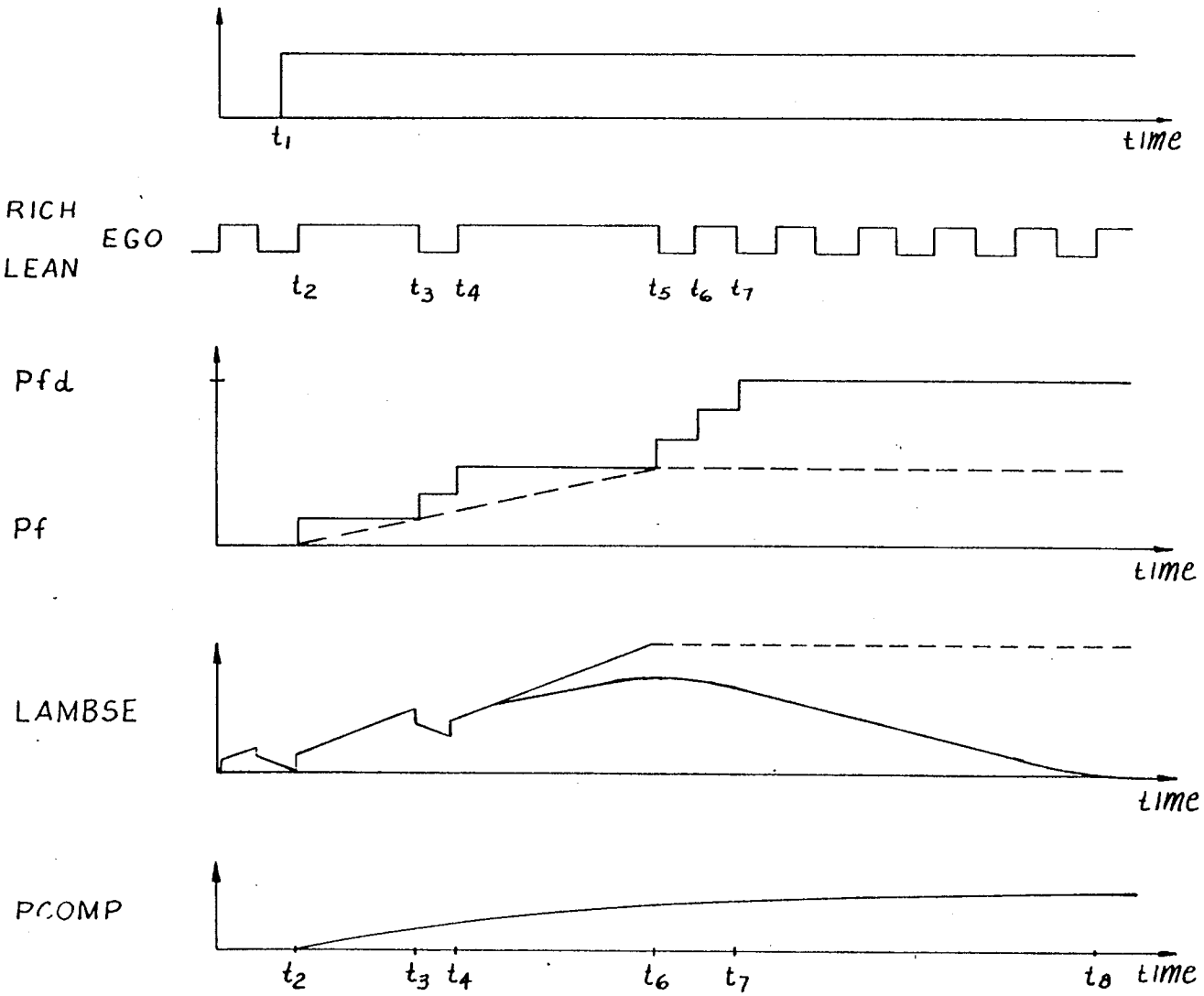
FIGS. 4A–4E are a graphical representation in accordance with the illustration shown in FIG. 3.

The corresponding proportional plus integral operation of signal LAMBSE is shown in FIG. 4E. Signal LAMBSE is shown first jumping upward due to its proportional term and then integrating upward after exhaust gas oxygen sensor 80 has switched at time $t_2$. In response, signal PCOMP is shown increasing as signal LAMBSE deviates from its reference value of unity.

At time $t_3$, exhaust gas oxygen sensor 80 is shown switching lean in response to correction of delivered liquid fuel by both signal LAMBSE and signal PCOMP (see FIG. 4B). In response, purge flow is again incremented a predetermined amount. This operation continues with exhaust gas oxygen sensor switching at times $t_4$, $t_5$, $t_6$, and $t_7$ until the maximum rate of purge flow is achieved (i.e., signal ppw at 100% duty cycle).

As previously described herein, with particular reference to fuel vapor control system 34, signal PCOMP adaptively learns the deviation in air/fuel ratio caused by induction of rich fuel vapors and forces signal LAMBSE back to its value before introduction of purge as shown at time $t_8$ in FIGS. 4E and 4F. Accordingly, air/fuel feedback system 28 then has a full operating range of authority during purge operations unlike prior approaches. For illustrative purposes, operation indicative of prior approaches is shown by dashed lines in FIGS. 4D and 4E. The particular prior approaches indicated, which did not have any function similar to fuel vapor control system 34, inhibited the rate of purge flow when signal LAMBSE (or its functional equivalent) reached a value corresponding to the operating range of authority of the air/fuel feedback system. This limit is illustrated at time $t_5$ in FIGS. 4D and 4E. Accordingly, such prior approaches may not maximize purge flow as does the invention herein described. A disadvantage of such approach is unnecessary emission of hydrocarbons into the atmosphere.

This concludes the description of the Preferred Embodiment. The reading of it by those skilled in the art will bring to mind many modifications and alterations without departing from the spirit of the invention. Accordingly, it is intended that the invention be limited only by the following claims.

What is claimed:

1. A control system for a vehicle having a fuel vapor recovery system coupled between a fuel supply system and an intake manifold of an internal combustion engine, comprising:

an exhaust gas oxygen sensor coupled to the engine exhaust providing a rich output indication when engine exhaust gases are richer than a predetermined value and providing a lean output indication when said engine exhaust gases are leaner than said predetermined value;

purging means coupled to the fuel supply system and the fuel vapor recovery system for purging a vapor mixture of fuel vapor and purged air into the engine air/fuel intake; and purge control means for increasing flow rate of said purged vapor mixture by a predetermined amount when said exhaust gas oxygen sensor changes from said rich output indication to said lean output indication.

2. The control system recited in claim 1 wherein said purge control means further increases said flow rate when said output indication changes from said lean output indication to said rich output indication.

3. The control system recited in claim 1 wherein said purge control means decreases said flow rate when said output indication fails to change for a predetermined time.

4. A control system for a vehicle having a fuel vapor recovery system coupled between a fuel supply system and an intake manifold of an internal combustion engine, comprising:

purging means coupled to the fuel supply system and the fuel vapor recovery system for periodically purging a vapor mixture of fuel vapor and purged air into the engine air/fuel intake;

feedback means coupled to an exhaust gas oxygen sensor for providing an air/fuel ratio indication of engine operation;

first correction means responsive to said air/fuel ratio indication and a measurement of airflow inducted into the engine for providing a base fuel command;

learning means responsive to a deviation in said air/fuel ratio indication from a desired air/fuel ratio for providing a measurement of fuel vapor content in said urged vapor mixture;

second correction means for subtracting a value related to said fuel vapor content measurement from said base fuel command to form a modified base fuel command and providing delivery of liquid fuel to the engine in relation to said modified base fuel command; and purge control means for increasing flow rate of said purged vapor mixture by a predetermined amount whenever said exhaust gas oxygen sensor changes from said rich output indication to said lean output indication.

5. The control system recited in claim 4 wherein said learning means has a slower response time than said feedback means.

6. The control system recited in claim 4 wherein said learning means integrates said deviation to provide said measurement.

7. A control system for a vehicle having a fuel vapor recovery system coupled between a fuel supply system and an intake manifold of an internal combustion engine, comprising:

induction means for inducting a mixture of ambient air and liquid fuel into the air/fuel intake;

purging means coupled to the fuel supply system and the fuel vapor recovery system for periodically purging a vapor mixture of fuel vapor and purged air into the engine air/fuel intake;

an exhaust gas oxygen sensor coupled to the engine exhaust providing an output indication in a first state when engine exhaust gases are richer than a predetermined value and providing said output indication in a second state when said engine exhaust gases are leaner than said predetermined value;

feedback means coupled to said exhaust gas oxygen sensor for providing an air/fuel ratio indication of engine operation and for correcting said liquid fuel inducted into the engine in response to said air/fuel ratio indication;

learning means responsive to a deviation in said air/fuel ratio indication from a desired air/fuel ratio for providing a measurement of fuel vapor content in said purged vapor mixture, said learning means also correcting said inducted liquid fuel in response to said fuel vapor content measurement to maintain said desired air/fuel ratio during said periodic purging; and purge control means responsive to said learning means for incrementing rate of purge flow from zero flow at initiation of said periodic purging to a desired and substantially constant rate of purge flow by increasing said rate of purge flow a predetermined amount when said exhaust gas oxygen sensor changes said output indication.

8. The control system recited in claim 7 wherein said liquid fuel is supplied by an electrically actuated fuel injector having an on time determined by both said feedback means and said learning means.

9. The control system recited in claim 8 wherein said purging control means decreases said rate of purge flow when said on time is below a predetermined value.

10. The control system recited in claim 7 wherein said purge control means decreases said rate of purge flow when said measurement of fuel vapor content exceeds a predetermined proportion of both said liquid fuel and said purged fuel inducted into the engine.

11. A method for controlling engine air/fuel ratio operation in a vehicle having a fuel vapor recovery system coupled between a fuel supply system and an intake manifold of an internal combustion engine, comprising the steps of:

inducting a mixture of ambient air and liquid fuel into the air/fuel intake;

periodically purging a vapor mixture of fuel vapor and purged air from both the fuel system and fuel vapor recovery system into the engine air/fuel intake;

providing an rich indication when oxygen content in engine exhaust gases are less than a predetermined value and providing a lean indication when said oxygen content is greater than said predetermined value;

generating an air/fuel ratio indication of engine operation and correcting said liquid fuel inducted into the engine in response to said air/fuel ratio indication;

measuring fuel vapor content in said purged vapor mixture by determining a deviation in said air/fuel ratio indication from a desired air/fuel ratio;

correcting said induction of liquid fuel in response to said fuel vapor content measurement to maintain said desired air/fuel ratio during said step of periodic purging; and incrementing rate of purge flow from zero flow at initiation of said periodic purging to a desired and substantially constant rate of purge flow by increasing said rate of purge flow a predetermined amount when said rich indication of oxygen content changes to said lean indication.

12. The method recited in claim 11 wherein said step of measuring said fuel vapor content further comprises a step of integrating said deviation to provide said measurement of fuel vapor content.

13. The method recited in claim 11 wherein said incrementing step increases said rate of purge when said lean indication of oxygen content changes to said rich indication.

14. The method recited in claim 11 wherein said incrementing step decreases said rate of purge flow when said fuel vapor content measurement indicates said fuel vapor content exceeds a predetermined percentage both said liquid fuel and said fuel vapor.

15. The method recited in claim 11 wherein said purging step is disabled when said fuel vapor content measurement indicates said fuel vapor content exceeds both said liquid fuel and said fuel vapor during deceleration of the engine.

* * * * *